United States Patent [19]

Vance et al.

[11] Patent Number: 4,693,034

[45] Date of Patent: Sep. 15, 1987

[54] MASTER PATTERN ASSEMBLY FOR LENS CIRCUMFERENCE GRINDING

[76] Inventors: David F. Vance, Rte. #2, Box 228 EE, Bloomfield, Ky. 40008; Michael Jakubowicz, 4701 Lacarem Dr., Jeffersontown, Ky. 40299

[21] Appl. No.: 774,580

[22] Filed: Sep. 10, 1985

[51] Int. Cl.[4] ..... B24B 9/00

[52] U.S. Cl. ..... 51/101 LG; 51/284 E; 51/216 LP

[58] Field of Search ..... 51/101 LG, 216 LP, 284, 51/227 R, 216 LP, 323

[56] References Cited

U.S. PATENT DOCUMENTS 3,962,833 6/1976 Johnson ..... 51/216 LP

*Primary Examiner*—Frederick R. Schmidt

*Assistant Examiner*—Maurina Rachuba

*Attorney, Agent, or Firm*—John S. Hale

[57] ABSTRACT

A master pattern assembly for providing eyeglass lens circumference shape guidance in an edge grinding machine, suitable for creation of a replacement lens for eyeglasses where one lens is broken and one remains intact. The intact lens is removed from the frame, its optical center is located, and the lens is adhered to a dual-adhesive pad which is also adhered on a side opposite the lens to a body block. The block and pad define coaxial throughgoing bores centered on the optical center of the lens. The bore of the block is then received on a rotatable axis of a conventional edge grinding machine, where the assembly is rotated and the circumference of the intact lens acts as a cam in contact with a pattern follower, controlling circumference formation of a new lens.

5 Claims, 5 Drawing Figures

MASTER PATTERN ASSEMBLY FOR LENS CIRCUMFERENCE GRINDING

BACKGROUND OF THE INVENTION

The present invention relates to preparation of lenses for vision improvement and, more specifically, to a novel and useful new improvement in the preparation of a lens circumference for secure fitting a pre-existing frame.

In the vision assistance industry, it is a very common situation to be presented with an existing pair of eyeglasses of known optical characteristics wherein one of the lenses has been destroyed, although the frame remains intact. For reasons of economy, replacement of a single broken lens is increasingly preferred over the alternative of manufacturing a complete substitute set of eyeglasses. This is partly due to the development of the market for designer frames. As in other fashion-driven markets, designer frames purchased at any given time may be obsolete and no longer available from the manufacturer only months later. Thus obtaining a desired but obsolete designer frame often becomes a major factor of both cost and delay in providing the customer with vision assistance. For all of these reasons, it is often preferred to utilize the existing frame and fit a new lens to that frame.

However, a further difficulty has arisen, also as a result of the market for designer frames. There is no longer a standard outline or circumference for lenses used in eyeglasses. Not only the lens size but the circumference has seen variation over a broad range of patterns. Some lenses are approximately circular in shape, whereas other lenses are approximately rectangular in character while others are approximately triangular or some combination of these attributes.

One method of conforming lenses to frame sockets is currently widely used in the retail vision assistance field. In this method, a damaged lens is removed from the frame, and the circumference of the open socket is duplicated by tracing the inside thereof with a pencil or the like onto a flat cuttable blank. This blank is typcially made of light-weight stiff plastic which permits cutting so that the blank is ultimately contoured to fit in the empty socket. The blank thus contoured is then mounted to serve as the master pattern in an edging machine such as those which are commercially available from Weco or AIT. In the edging machine, both the contoured pattern and a replacement lens are mounted on a floating axle which is turned by a motor. As the axle turns, the circumference of the contoured pattern is rotated in proximity with a pattern follower wheel while the lens is rotated in contact with a grinding surface. The grinding surface selectively reduces the radius of each segment of the lens periphery, relative to its center, until the radius of a segment equals that of the corresponding portion of the contoured pattern. The contoured pattern thereafter acts as a cam and maintains the floating axle at a height above the grinding surface so that no further grinding takes place on that portion of the circumference. The process is completed when the portion at the shortest radius from the lens center is completely ground. The lens is then removed and placed in the frame socket.

If it is desired to produce two lenses for an eyeglass frame, either the contoured pattern or the second new lens may be reversed on the floating axle so as to take advantage of mirror-image symmetry of eyeglass frame sockets relative to one another. The grinding process then continues in the same fashion until the edge of the second new lens is completely contoured to fit the remaining frame socket.

There are several detrimental aspects of this procedure which contribute to its costliness and increase the time required for successful completion. First, the pattern blank must be accurately cut and contoured to fit the open socket of the frame. This is not easily achieved by the present method of tracing through the socket onto the pattern. Since tracing is a manual step, such factors as pen angle variance and motion of the blank or frame can adversely effect the accuracy of the resulting trace. Therefore, it is typical for the practitioner to make an initial cut outside the trace and then reiterate a process of trimming the pattern and testing its fit in the socket. Errors which reduce any portion of the pattern contour below the size needed for snug fit in the socket require recommencement of the process.

Another difficulty is related to the manner in which the contoured pattern is related to the new lens to be contoured. All such new lenses are optically ground prior to edge grinding. After optical preparation, each lens must be carefully centered on the floating axle of the edge grinder. A common off-the-shelf device known as a lensometer is utilized to locate and mark the optical center of each lens. The lens is then mounted to the floating axle in a well-known manner. The contoured pattern is flat and exhibits no optical surface having a pre-defined optical center. However, careful measurement of the wearer's eyes can yield a determination of where the optical center of each lens should be placed in the frame. It is then possible, though not easy, to prepare a contoured pattern having a center hole located precisely where the optical center of the lens should be. This hole is then used as the bore through which the contoured pattern is mounted on the floating axle of the edge grinder. The precise location of this hole relative to the predetermined optical center is another step requiring great precision and which frequently leads to mistakes which are costly and time-consuming to correct.

Moreover, it should be recognized that most eyeglass frame sockets do not offer a flat or planar surface when laid against a pattern to be traced and cut. This further contributes to the likelihood of errors in the process.

The present inventors are aware of other edging systems in the prior art.

U.S. Pat. No. 765,268 shows a stencil 52 mounted on a shaft 51. A follower 24 contacts the stencil 52 and is mechanically coupled so that as the follower encounters higher or lower portions of the stencil, an etcher will mimic the same motion against a blank 59. However, it is especially useful to note that the mounting of both the stencil and the blank are on flat surfaces thereof, and not against an optically curved surface.

Not all edging machines are applied to lenses or even glass. U.S. Pat. No. 548,298 discloses a key duplicator in which an existing key is surfaced as a stencil, and is gripped on opposite sides. A follower floats against the ridges of the key and is mechanically coupled to an edger which inscribes substantially identical ridges in a key blank. Of course, this reference does not involve gripping optical surfaces.

U.S. Pat. No. 3,641,711 discloses a machine which is specifically designed for conforming edges of glass to a pre-determined form. However, the form is a track 33 rigidly mounted on posts 34. A follower contacts and moves about the edge of the template and carries an edge grinding tool around a glass blank to produce a corresponding shape. This machine does not contemplate random variations in a template to match nonstandardized eyeglass frame requirements. It is apparently intended primarily for mass production of items such as decorative windows or table surfaces.

U.S. Pat. No. 2,356,448 discloses an apparatus in which a lens or similar article is supported on a curved surface. As seen in FIG. 3, the stencil 56 is supported at 57, and made to contact follower roller 63 which in turn drives edge grinding of a number of duplicate lens objects. However, the reference does not consider the stencil 56 to be readily removable, and does not specify the manner in which the support 57 grips the stencil 56. This implies that the stencil 56 is permanently mounted. This and the production of multiple duplicate lenses strongly suggest that the machine is a mass production device.

It therefore remains clear that there is a need and a demand for a reliable system of circumference tracing and duplication which avoids the various sources of error seen in the prior art. The system should accommodate rapid optical centering of the contoured pattern, as well as mounting of the pattern at its predetermined center to the floating axle of the grinding system. The improvement should require little or no change of the present edge grinders now universally utilized in the retail vision assistance industry.

SUMMARY OF THE INVENTION

The present invention provides a reliable system of circumference duplication for manufacture of replacement lenses fitted to existing frames. According to the invention, an intact lens is removed from the frame and utilized as the pattern in an edging machine. A mounting block is provided with an axial throughgoing bore and a curved surface at one end of the bore which bears an adhesive pad for joining the mounting block to the lens. After the optical center of the existing lens is determined with the aid of a lensometer, the intact lens is compressed against the pad so the optical center of the lens is sighted in the throughgoing bore. The bore is then mounted to the floating axle of the edging machine, and the circumference of the existing lens may make contact with the pattern follower wheel of the edging machine to provide control of the edge grinding process as the floating axle rotates.

It is clear that the present invention accommodates rapid optical centering of the contoured pattern as well as mounting of the pattern at its predetermined center to the floating axle. The present invention makes use of the existing edge grinders universally utilized in the retail vision assistance industry, and requires only minor and inexpensive adaptation of the edge grinders. The risk of error of pattern cutting is eliminated, with corresponding substantial savings in time and material costs.

Although the invention is set forth in the claims below, the invention itself and the method by which it is made and used may be better understood by referring to the following description taken in connection with the accompanying drawings forming a part hereof, in which like reference numerals refer to like parts throughout the several views.

DETAILED DESCRIPTION OF THE DRAWINGS

Figure 1:
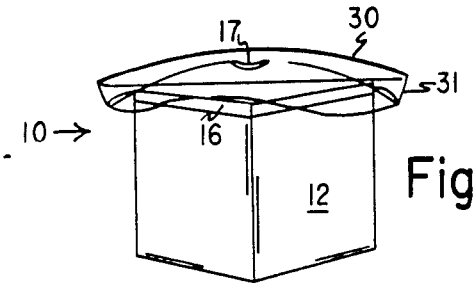
FIG. 1 is a perspective view of a master pattern assembly according to the present invention.
Figure 2:
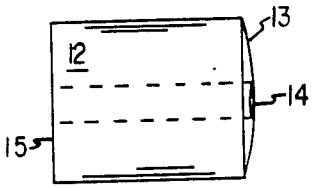
FIG. 2 is an isolated side view of a body block component of the apparatus of FIG. 1.

The best mode and preferred embodiment of the present invention is illustrated in FIG. 1, and comprises a master pattern assembly generally indicated at 10. The assembly 10 in turn comprises a body block 12, a pad 16 and a lens 30. Body block 12 is preferably of generally rectilinear form, that is, having six rectangular surfaces with adjacent surfaces intersecting at approximately 90 degree angles. For reasons which will be set forth below, the opposed largest rectangular surfaces of the body block 12 preferably exhibit square outlines with sides 1 inch in length. As best seen in FIG. 2, the bottom square surface 15 is flat, and the top square surface 13 exhibits a curvature appropriate for secure contact to the curved optical surface of an existing lens. A throughgoing bore 14 is defined in the body block 12 to extend axially through the body block 12 between the bottom surface 15 and top surface 13.

An adhesive pad 16 is provided as an interface between the curved top surface 13 of the body block 12 and the curved surface of a pre-existing lens. Such adhesive pads are now available from a number of firms including TNT Optical Sales, Inc. of Pontiac, Mich. Each pad comprises a base pad 19 of generally flexible rubber-like material, with opposed broadest surfaces preferably square in contour, each edge of the square surfaces being 1 inch long. Centered in each broadest surface is a throughgoing sight bore 17 of approximately three tenths of an inch in diameter, and both broadest surfaces of the pad are coated with an adhesive substance recently marketed by 3M Corporation for use in optical applications. This adhesive provides strong nondamaging junctions with optical glass surfaces. Such a pad is known to adhere to a pre-existing lens from a frame for eyeglasses, and to permit removal of the pad and the remaining adhesive material from the lens without any permanent or transitory adverse effect on the lens.

Body block 12 is made of any plastic or rubber compound which provides solid contact and adherence with the commercial adhesive delivered on the pad 16. According to the present invention, one side of the adhesive pad 16 is applied to the top surface 13 of the body block 12, with the bore 14 and bore 17 axially aligned. To maximize the area of surface contact and thereby strength of the junction, the shape and size of the top surface 13 are chosen so that a broadcast surface of pad 16 may completely adhere to top surface 13, while leaving lens circumference 31 exposed and able to act as a cam surface in the assembly 10. More specifically, top surface 13 is shaped and pad 16 is oriented so that any radius drawn from the bores 14 and 17 across pad 16 crosses an edge of top surface 13 at a distance equal to or greater than the distance at which the same radius crosses an edge of pad 16, and less than the distance at which the same radius crosses the circumference 31 of lens 30. Thus, when a lens is joined to the pad 16 opposite the body block 12, the assembly may be mounted to the floating axle of an edging machine via bore 14, and the resulting structure will exhibit excellent resistance to torsion and shear forces applied to the junction of the lens and the pad 16. In the preferred embodiment, the edge of top surface 13 is square with sides equal in length to the sides of pad 16.

Figure 3:
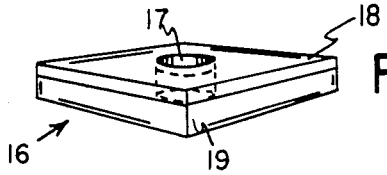
FIG. 3 is an isolated perspective view of an adhesive pad component of the apparatus of FIG. 1.

The adhesive pads 16 are commercially delivered in the form of a sheet having a common slick-paper backing, so that each adhesive pad 16 is initially applied to a top surface 13 of a body block 12 by removing the pad from the backing sheet and applying the exposed surface of the pad, which was previously in contact with the backing, to the top surface 13. As seen in FIG. 3, each pad is also commercially delivered with an individual cover 18 which prevents unwanted adherence to the pad 16 on the body block 12 until such time as the cover 18 is peeled away to expose the remaining adhesive surface of the pad 16.

Figure 5:
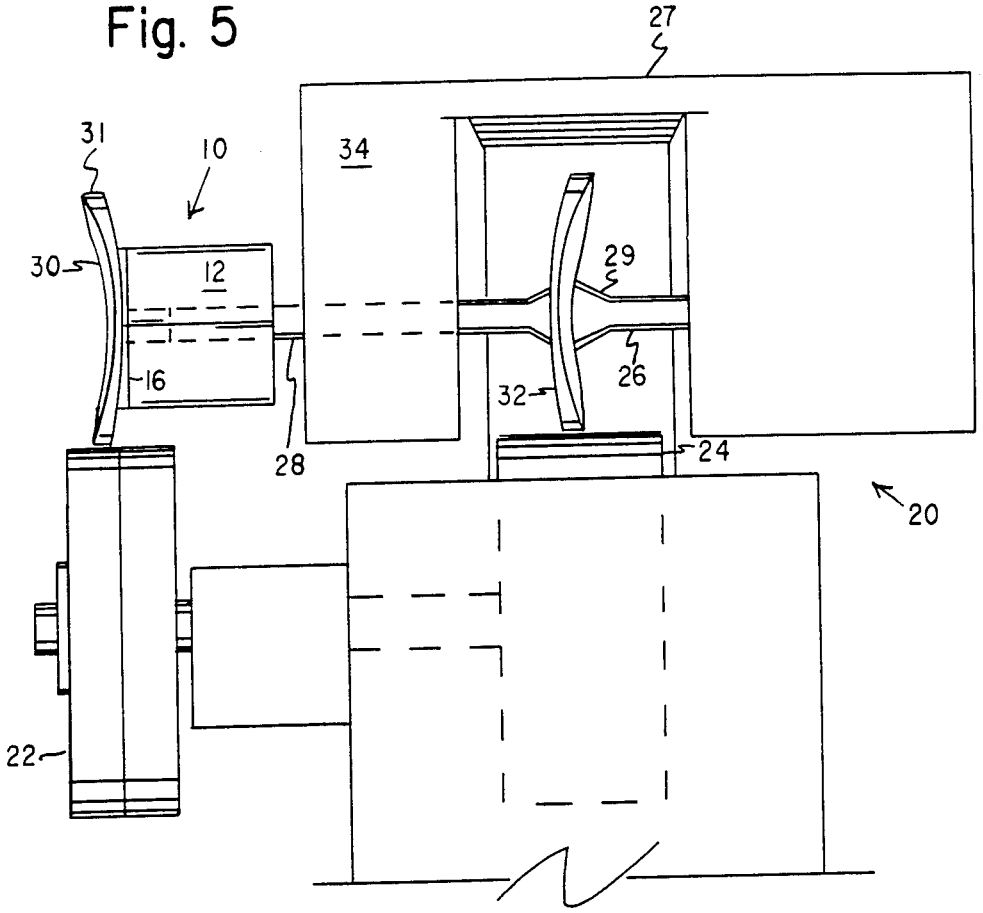
FIG. 5 is a side view of a lens edge grinder machine in which the apparatus of FIG. 1 is used.

A generalized commerical edging machine 20, such as is commonly used in the vision assistance industry, is illustrated in FIG. 5 and comprises a floating axle 26 incorporating a transmission 27, a cylindrical penholder 28 adjacent a pattern wheel 22 and a workholder 29 adjacent a grinding wheel 24. The penholder 28 and workholder 29 of the floating axle 26 are driven in synchronous rotation by the transmission 27. Workholder 29 is adapted in a well-known manner to hold and rotate a new lens 32 in contact with the grinding wheel 24. In the prior art the flat contoured pattern was bolted or otherwise secured to the penholder 28, and was rotated in intermittent contact with the pattern wheel 22 to act as a cam and limit the radius of each circumference segment of the new lens 32.

The present invention advantageously provides that the body block 12 carrying an adhesive pad 16 and an existing lens 30 is mounted to the holder 28. Because the lens 30 blocks the bores 14 and 17, the cylindrical penholder 28 is inserted in the bore 14 at the bottom surface 15 of the body block 12. The diameter of bore 14 is equal to or less than that of penholder 28, for secure tight fitting on penholder 28 and high friction therewith so that no slippage occurs as penholder 28 rotates to carry the body block, the pad 16 and the existing lens 30 in rotation synchronously with the new lens 32 mounted in conventional fashion to the workholder 29 of the floating axle 26.

Figure 4:
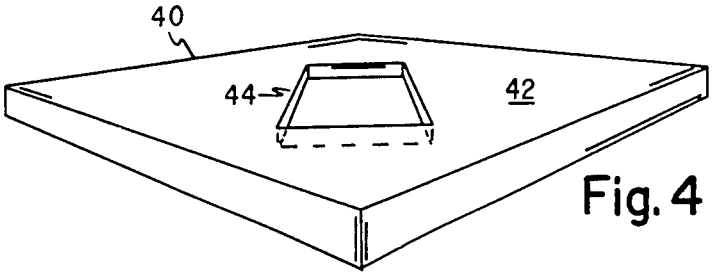
FIG. 4 is a perspective view of a setup holder used to assemble the apparatus of FIG. 1.

Also according to the present invention, in order to prepare the assembly 10 for installation on the edger machine 20, a setup holder 40 is provided as shown in Figure 4, including a generally rectangular body 42 and a square recess 44 defined in a broad horizontal side of holder 40. The recess 44 is preferably sized to snugly receive the bottom surface 15 of the body block 12 and the body block sides adjacent thereto. It is therefore preferred that the sides of the recess 44 by 1 inch in length, and the depth of the recess by at least ⅛th inch.

The bottom surface 15 of body block 12 is inserted in the rectangular recess 44 of the setup holder. An adhesive pad 16 is then selected and removed from its backing sheet, thereby exposing an adhesive surface of the pad 16. The adhesive surface is then placed securely in contact with the top surface 13 to form an adhesive junction therebetween so that the entire adhesive surface contacts top surface 13. With the body block still resting in the recess 44 of the setup holder 40, the cover 18 is then peeled away from the adhesive pad 16, exposing the remaining adhesive surface. Due to the curvature of the top surface 13, the adhesive pad 16 now exhibits the same curvature and will thus maintain maximum area of contact and adhesive junction with the lens 30.

Prior to placement of the lens 30 on the adhesive pad 16 and body block 12, the lens 30 is prepared by the well-known method of locating the optical center thereof with a lensometer. The optical center is thereafter aligned axially with the bore 17 and bore 14 at the time of joining the lens to the adhesive pad.

It should be recognized that the typical lens of eyeglasses provides both a concave surface on one side and a convex surface on the opposing side. The particular side in contact with the adhesive pad may vary depending on whether the right lens or left lens is serving as the pattern, and depending on whether the concave or convex surface of the corresponding new lens faces the pattern along the floating axle. Thus, the body block 12 will have a complementary curvature on top surface 13, either concave for a convex lens surface (as shown in FIG. 5) or convex for a concave lens surface (as shown in FIG. 1). While optical surfaces may vary in their degree of curvature according to the precise vision assistance need of the patient, it has been found that the adhesive pad 16 is sufficiently flexible and compressible that minor variances in the curvature of the top surface 13 and adhesive pad 16 relative to the lens 13 will not prevent adhesion of the lens 30 across the entire surface of the adhesive pad 16. Simple compression by hand of the lens 30 against the adhesive pad 16 for a period of 2 to 3 seconds while the body block 12 is held in the setup holder 40 will assure that any gaps caused by curvature differences are eliminated. The body block 12 is then removed from the recess 44 of the holder 40, and may be mounted to the penholder 28 by insertion of the penholder into the bores 14.

Certain standard commercial edging machines may require slight adaptation in order to accommodate the body block 12 of the present invention. As an example, the popular Weco edger machine will require a penholder which is shortened from the standard length to a length of 8 millimeters. Additionally, the standard pattern follower wheel of this commerical edger machine should be doubled in width to 30 millimeters, which can be easily accomplished by mounting a second standard pattern wheel directly adjacent and in contact with the first on its axle. These modifications are necessary because the body block 12 causes the pre-existing lens 30 to be mounted farther from the transmission 27 than the conventional flat pattern which was mounted directly to the penholder. Also, it should be recognized that the curvature of pre-existing lenses occasionally results in a lens contour which does not lie in or rotate in a single plane. Therefore the pattern wheel 22, which must contact the entire contour of the pre-existing lens 30 at the time when grinding of the new lens 32 is needed, must be widened correspondingly to extend farther along it's axle.

In use, as shown in FIG. 5, the transmission 27 rotates the floating axle 26, thereby carrying the penholder 28, body block 12, adhesive pad 16 and pre-existing lens 30 in rotation adjacent the pattern wheel 32. Synchronous with that rotation, the workholder 29 and new lens 32 rotate adjacent a grinding wheel 24. The existing lens 30 now acts as a cam, contacting pattern wheel 32 and selectively blocking further downward pressure of floating axle 28 and new lens 32 against the grinding wheel when the circumference portion of the new lens 32 is ground to a radius from its optical center equal to that of the corresponding circumference portion of the existing lens from the optical center of the existing lens. When the entire circumference of the new lens 32 is ground to match the circumference of the pre-existing lens 30, the entire circumference of the lens 30 is in contact with the pattern wheel 22 as the floating axial 26 rotates. At this time edge formation is completed and the lenses may be removed from the edger.

It should also be noted that the optical surfaces of the new lens 32 are gound prior to the edging procedure.

What is claimed is:

1. A rotatable master pattern assembly for formation of a circumference on a new lens in an edge grinder, based on an existing original lens adapted to fit in an frame serving as the pattern lens comprising: a compressible adhesive pad of known shape having first and second opposed broadest surfaces bearing adhesive for optical lenses and defining a centered throughgoing sight bore; a pre-existing formed eyeglass lens having an optically shaped side surface with a known optical center and having a circumference known to fit in a frame; and a body block having a top surface curved to substantially complement said optically shaped side surface of said preexisting eyeglass lens, said body block defining an axial throughgoing equal diameter bore centered in said top surface and adapted to surround and engage a cylindrical penholder of an edge grinder machine; said top surface of said body block adhering to said first broadest surface of said adhesive pad such that said axial body block bore is aligned with said sight bore of said adhesive pad and said top surface adhesively contacts said first broadest surface; said optically shaped side surface of said preexisting eyeglass lens adhering to said second broadest surface of said adhesive pad such that such optical center of said surface of said preexisting eyeglass lens is centered in said sight bore of said pad.

2. An apparatus as claimed in claim 1, wherein said top surface of said body block defines a square edge, and said broadest surfaces of said adhesive pad defines a square edge with sides equal in length to sides of said edge of said top surface of said body block.

3. Apparatus as claimed in claim 1, wherein said body block is sized and shaped so that said circumference of said pre-existing lens is completely exposed for contact with a pattern follower wheel of said edge grinder.

4. Apparatus as claimed in claim 1, wherein said body block and said pad are positioned with respect to said pre-existing lens so that any radius drawn from said bores to the circumference of said pre-existing lens crosses an edge of said pad at a first distance from said bores, crosses an edge of said block at a second distance from said bores greater than or equal to said first distance, and crosses said circumference of said pre-existing lens at a third distance from said bores greater than said second distance.

5. A rotatable master pattern assembly for the formation of a circumference on a new lens in an edge grinder using a preexisting eyeglass lens having an optically shaped side surface with a known optical center and having a circumference known to fit in a frame; comprising: a compressible adhesive pad of known shape having first and second opposed surfaces bearing adhesive for optical lenses and defining a throughgoing sight bore centered in said opposed surfaces; a body block defining an axial throughgoing bore adapted to surround and engage a cylindrical penholder of an edge grinder machine; said body block defining a curved top surface to substantially complement the optically shaped side surface of a preexisting eyeglass lens, said top surface of said body block adhering to said first surface of said adhesive pad such that said axial bore is axially aligned with said sight bore and said top surface completely contacts said first surface with the second surface of said adhesive pad adhering to the side surface of the preexisting eyeglass lens and said sight bore being aligned with the optical center of said preexisting eyeglass lens.

* * * * *